US005690162A

United States Patent [19]

Ishikawa

[11] Patent Number: 5,690,162

[45] Date of Patent: Nov. 25, 1997

[54] VERTICAL-TYPE CONTINUOUS CASTING METHOD AND APPARATUS

[75] Inventor: Toshiyuki Ishikawa, Toyama-ken, Japan

[73] Assignee: YKK Corporation, Tokyo, Japan

[21] Appl. No.: 646,390

[22] Filed: May 8, 1996

[30] Foreign Application Priority Data

May 12, 1995 [JP] Japan ..... 7-114190

[51] Int. Cl.[6] ..... B22D 11/00; B22D 23/00; B22D 11/08

[52] U.S. Cl. ..... 164/459; 164/420; 164/129; 164/483

[58] Field of Search ..... 164/459, 420, 164/444, 487, 483, 129

[56] References Cited

U.S. PATENT DOCUMENTS 4,562,876 1/1986 Hargassner et al. ..... 164/459

*Primary Examiner*—Joseph J. Hail, III
*Assistant Examiner*—L-H. Lin
*Attorney, Agent, or Firm*—Hill, Steadman & Simpson

[57] ABSTRACT

In vertical-type continuous casting in which a plurality of ingots are cast by pouring molten metal into a plurality of molds each composed of upper and lower dies and by lowering the lower dies in a predetermined path at a casting speed, the upper dies having different casting diameters are arranged on a common table for casting the ingots of different diameters simultaneously on the table 8.

6 Claims, 5 Drawing Sheets

VERTICAL-TYPE CONTINUOUS CASTING METHOD AND APPARATUS

BACKGROUND OF THE INVENTION

1. Field of the Invention

This invention relates to a vertical-type continuous casting machine, and more particularly to a vertical-type continuous casting machine for simultaneously casting a predetermined number of ingots of different diameters.

2. Description of the Related Art

Many kinds of aluminum alloys to be used for various kinds of building materials are currently known. Particularly for sashes such as front doors and storm doors, an alloy classified as "A6063" according to JIS (Japanese Industrial Standard) standards have been used. This A6063 aluminum alloy is an alloy which is made by adding a small quantity of magnesium (Mg) and silicon (Si) to aluminum (Al) and is particularly suitable for extrusion and surface treatment, and extruded products using this alloy are excellent in toughness, plastic workability and machinabllity, particularly in corrosion resistance.

In manufacturing this A6063 aluminum alloy, 20 kg-ingots of aluminum, a required weight of Al—Si alloy ingot, and junk materials, such as inferior goods of aluminum building materials, are thrown into a melting furnace with a predetermined ratio by weight. In the melting furnace, the alloy materials are melted into a molten state as heated by a burner, whereupon the molten metal is then conveyed to a holding furnace, for the next process, via a conduit, during which a desired amount of magnesium Mg is added to the molten metal. The reason why magnesium Mg is usually added to the molten metal while the molten metal is conveyed in the conduit is that magnesium Mg is an easily oxidizable substance.

In the holding furnace, the resulting molten metal is maintained at about 700° C. as heated by a burner. The ingredients of the molten metal in the holding furnace are analyzed by an ingredient analyzer, and on the result of the analysis, the shortage, if any, is supplied. The individual amounts of Al, Si and Mg as defined according to the JIS standards, are calculated before being thrown into the melting furnace. Then, the calculated amounts of Al and Si are thrown into the melting furnace, and the calculated amount of Mg is added to the molten metal flowing in the conduit. Practically, however, since a slight difference would occur in ratio of ingredients of the molten metal conveyed to the holding furnace, such difference of ingredient ratio is adjusted in the holding furnace. Also in the holding furnace, various slags floating on the surface of the molten metal are removed, and then the molten metal is maintained below a predetermined temperature, during which the molten metal is stirred so as to be at a uniform temperature over the entire part.

The molten metal thus kept at a predetermined temperature and adjusted in composition in the holding furnace is subsequently conveyed to a molten metal processing unit via another conduit, during which an Al—Ti—B alloy is continuously added to the molten metal. This Al—Ti—B alloy serves to granulate crystal particles of Al alloy when the molten metal becomes solidified in the casting process. The molten metal processing unit has a molten metal well and a rotary shaft for stirring the molten metal in the molten metal well and terminating at an end, from which inert gas (argon gas) is jetted in bubbles into the molten metal to pick up hydrogen molecules out of the molten metal. The hydrogen molecules existing in the molten metal remain in the form of bubbles in a ingot after solidification of the molten metal to form hollows in the ingot, thus causing lines or roughness on the surfaces of aluminum bars extruded from such ingot.

The gas-free molten metal is then conveyed to the next station where the molten metal is cast as an Al alloy ingot in the form of a cylinder having a predetermined length. In the vertical-type continuous casting, upon continuous flow of the molten metal into the tubular upper die, the molten metal is pulled downwardly by the lower die lowering at a predetermined speed. At that time, the molten metal passing through the upper die is gradually solidified as cooled by spraying water, and then the solidified part of the molten metal is gradually soaked into a water tank situated under the dies, thus obtaining a continuous length of ingot having a circular cross section. As disclosed in, for example, Japanese Utility Model Laid-Open Publication No. Hei 6-39245, the lower die has a recess in its upper surface.

FIGS. 5A, 5B and 5C show a typical ones of the foregoing conventional casting methods and apparatuses. As shown in FIGS. 5A, 5B and 5C, small-diameter ingots, intermediate-diameter ingots and large-diameter ingots are cast in their respective dedicated casting apparatuses. Namely, FIG. 5A shows a small-diameter-ingot casting apparatus; FIG. 5B, an intermediate-diameter-ingot casting apparatus; and FIG. 5C, a large-diameter-ingot casting apparatus. In these three casting apparatuses, many upper dies 70*a*, 70*b*, 70*c* having small, intermediate and large casting-diameters, respectively, are arranged on their respective dedicated tables 8. The upper dies 70*a*, 70*b*, 70*c* on each table 8 are different also in size from those of another table 8, depending on the respective casting diameter. As a result, a distance X1' between the centers of adjacent upper dies 70*a*, a distance X2' between the centers of adjacent upper dies 70*b*, and a distance X3' between the centers of adjacent upper dies 70*c* are different from one another, usually X1'<X2'<X3', thus making the outlines of the respective upper dies 70*a*, 70*b*, 70*c* larger in size.

The thus cast ingots are conveyed successively to a uniform-heat furnace as hung by chains, and in the uniform-heat furnace, an ingredient adjusting process takes place. The interior of the uniform-heat furnace is subdivided into a heating area and a uniform-heat area; the ingots are heated up at about 560° C. –590° C. in the heating area and are then moved to the uniform area where they are kept at a predetermined temperature for a predetermined period of time. This causes the micro- and macro-segregation of solute atoms, which are generated in the casting process of the Al-alloy ingot, to be distributed uniformly over the interior of the Al-alloy ingot by atomic diffusion.

After lapse of a predetermined uniform-heat time, the Al-alloy ingot is removed from the uniform-heat furnace and is then cooled by blowing air. As the solute atoms passed into a solution by the uniform-heat process start being deposited as $Mg_2Si$, the largeness of amount of this deposition gives a significant influence on both the extrudability of an ingot and the mechanical strength of an extruded bar. Sudden cooling by water increases the mechanical strength of an extruded bar and, on the other hand, it makes the extruded bar more resistant against extrusion deformation. On the contrary, slow cooling causes coarse deposition of $M_2Si$ and makes the extruded bar less resistant against extrusion deformation, but adequate mechanical strength of the extruded bar cannot be obtained. Consequently, in the conventional technology, it is essential to secure an appropriate cooling speed and also to control deposition of $M_2Si$.

However, in the above-mentioned conventional casting apparatus and method, as described in connection with FIGS. 5A, 5B and 5C, the number of small-diameter ingots to be cast at one time is twenty-four, the number of intermediate-diameter ingots to be cast at one time is twenty, and the number of large-diameter ingots to be cast at one time is sixteen; the total number of each kind of ingots to be produced is an integer-multiple of the number of the same kind of ingots to be cast at one time. As a result, excessive ingots would often be manufactured to increase the total stock, requiring both more space for storage and inventory management.

If many ingots having a specified diameter over an ordinary quantity of production are needed or if a required number of ingots having a specified diameter cannot be cast on a single casting apparatus, it is inevitable to replace all of the molds, which are dedicated for ingots having other diameters, with those for ingots having the specified diameter. This replacing is laborious work and time-consuming, and then, as a matter of course, ingots having the original diameters cannot be cast. Further, if the specified diameter is large, such molds are difficult to exchange with those having a smaller diameter.

SUMMARY OF THE INVENTION

It is therefore an object of this invention to provide an ingot casting method and apparatus which enables effective casting of a necessary number of ingots of a specified diameter so that the total stock of ingots can be reduced to a minimum, thus making a necessary storage space small and facilitating inventory management.

In order to accomplish the above object, according to a first aspect of this invention, there is provided a vertical-type continuous casting method for continuously casting a plurality of ingots by pouring molten metal into a plurality of molds each composed of upper and lower dies and by lowering the lower dies through predetermined stations at a casting speed, wherein the plurality of the upper dies have different casting diameters for casting the ingots of different diameters simultaneously on a common table.

According to a second aspect of the invention, there is provided a vertical-type continuous casting apparatus for continuously casting a plurality of ingots by pouring molten metal into a plurality of molds each composed of upper and lower dies and by lowering the lower dies through predetermined stations at a casting speed, wherein the plurality of the upper dies have different casting diameters and are arranged on a common table.

Preferably, the upper dies additionally include one or more auxiliary upper dies. Further preferably, all the upper dies have common profile and are arranged with a uniform distance between the centers of casting diameters of each adjacent pair of the upper dies. Further, the upper dies arranged on the table are divided into groups each composed of the upper dies of the same casting diameter, and their arrangement is such that distribution of load of the ingots may be substantially uniform.

For casting ingots of different diameters according to this invention, a lower die support standing by under the table is raised to fit the lower dies in with the corresponding upper dies, thus clamping the molds. With the molds clamped, cooling water is sprayed diagonally downwardly from the lower inside wall surface of each upper die via a ring-shape nozzle to cool the peripheral surface of the corresponding lower die. At the same time, molten metal is poured into a cavity defined by each set of upper and lower dies via the associated conduit. The quantity of molten metal to be poured should be adjusted by the diameter of ingots to be cast.

After all of the die cavities have been filled with molten metal, the lower dies are lowered toward and immediately short of the bottom of a water tank in synchronism with a predetermined casting speed. During that time, cooling water jetted from the nozzle is sprayed over the individual lower dies, and the successive cast ingots are thereby cooled to become solidified. The rate of spouting cooling water is controlled in conformity with the diameter of ingots to be cast.

Each lower die being lowered is stopped upon arrival at such a predetermined level in the water tank that a predetermined casting length of each ingot can be obtained. Then the lower die support is raised again until the upper end of every ingot projects upwardly from the table. Subsequently, using a crane or other means, all of ingots of different diameters are pulled upwardly simultaneously and are conveyed from the casting apparatus to the uniform-heat furnace for next process.

DETAILED DESCRIPTION OF THE PREFERRED EMBODIMENT

The illustrated embodiment shows a vertical-type continuous casting apparatus for casting Al-alloy ingots as material bars from which aluminum building materials are to be produced by extrusion.

Figure 1:
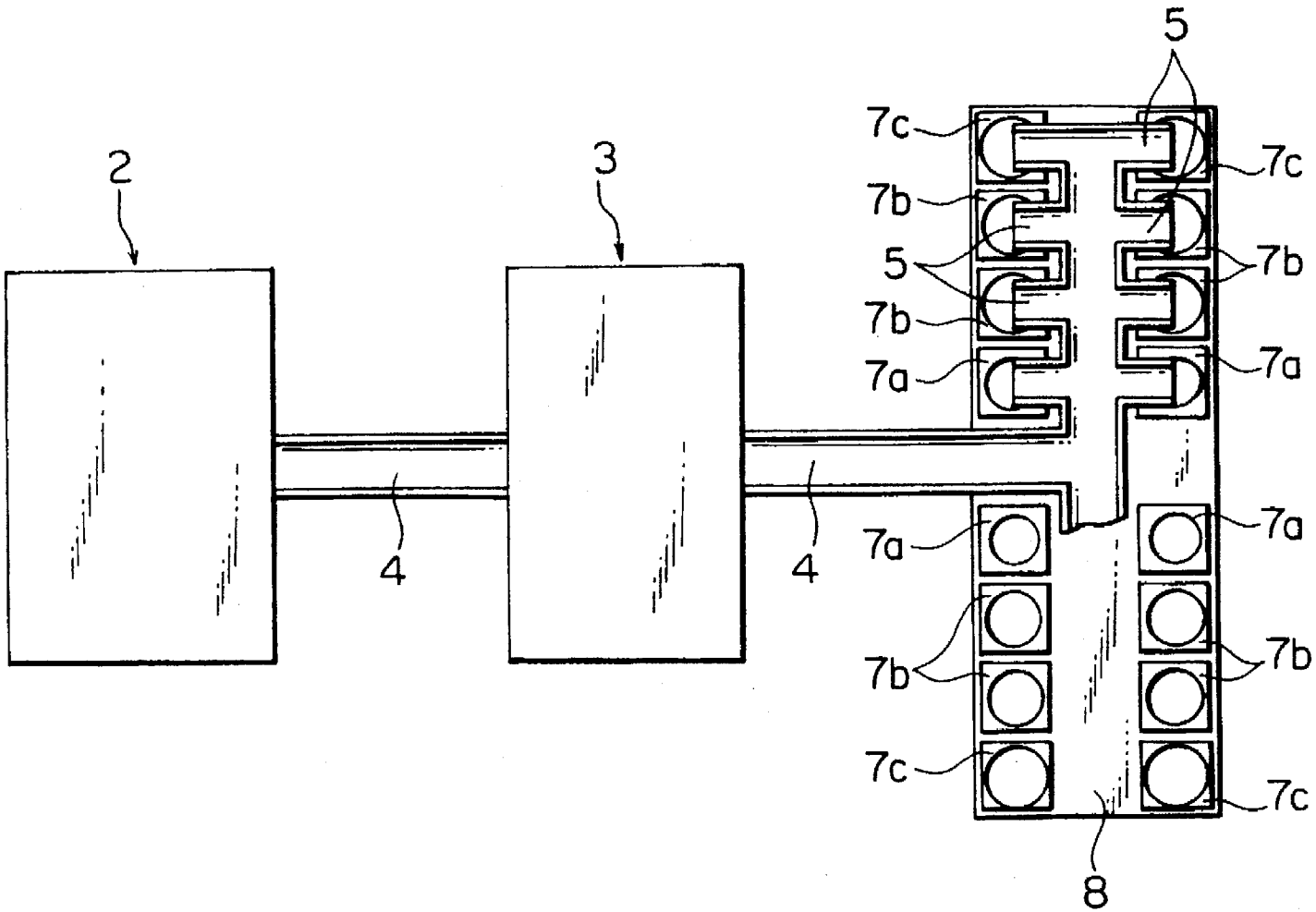
FIG. 1 is a plan view, with parts broken away, of a vertical-type continuous casting apparatus according to a typical embodiment of this invention.
Figure 2:
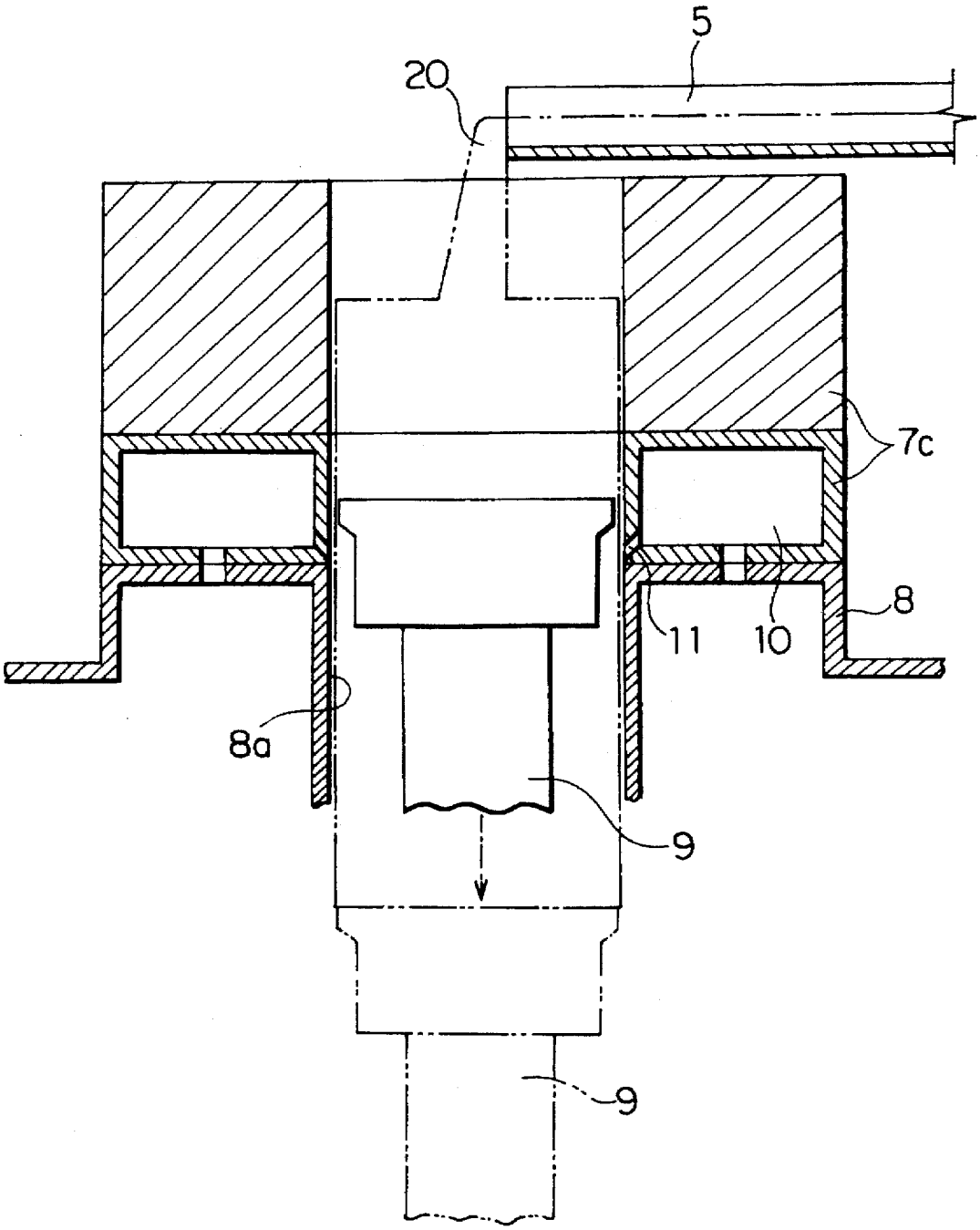
FIG. 2 is a fragmentary cross-sectional view of the casting apparatus of FIG. 1, showing in detail the interior structure of a casting section of the apparatus.
Figure 3:
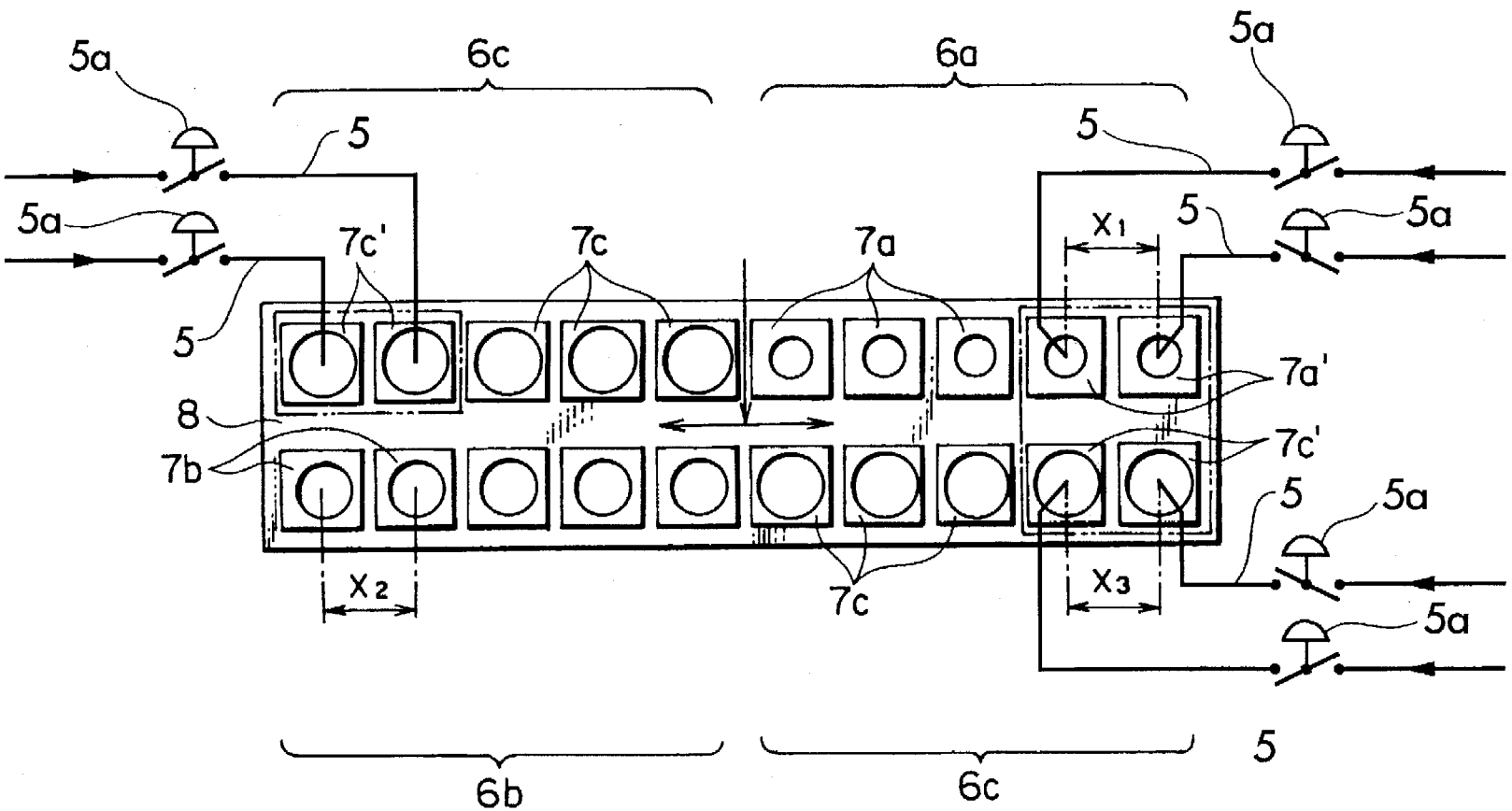
FIG. 3 is a plan view showing an example of arrangement of upper dies of different diameters in the casting apparatus.
Figure 4:
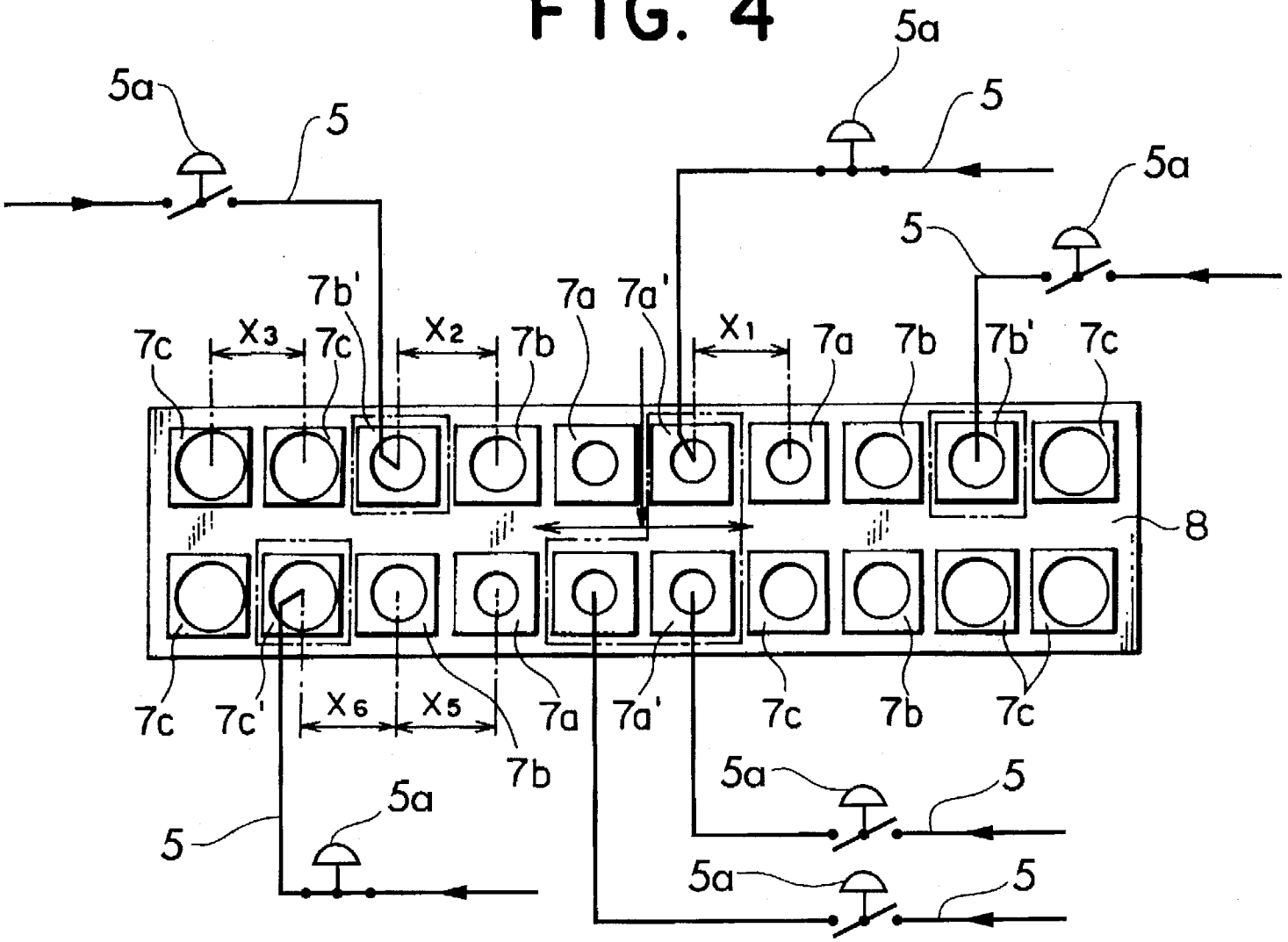
FIG. 4 is a plan view showing another example of arrangement of upper dies of different diameters in the casting apparatus.
Figure 5A:
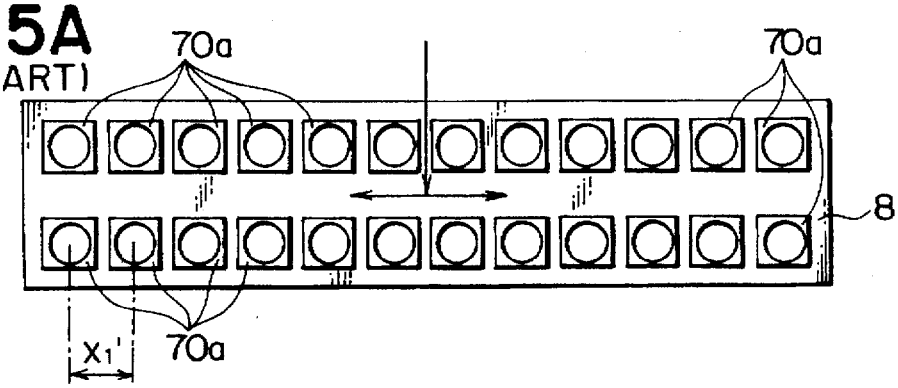
FIG. 5A (PRIOR ART)
FIGS. 5A, 5B and 5C are plan views showing arrangements of upper dies in a conventional casting apparatus.
Figure 5B:
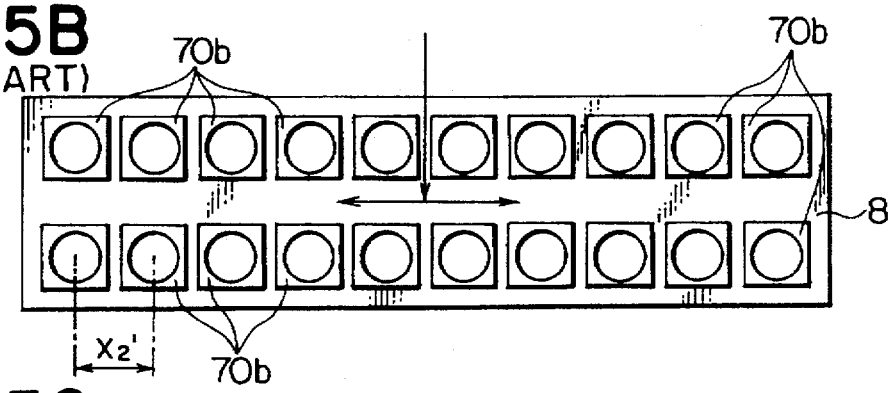
FIG. 5B (PRIOR ART)
Figure 5C:
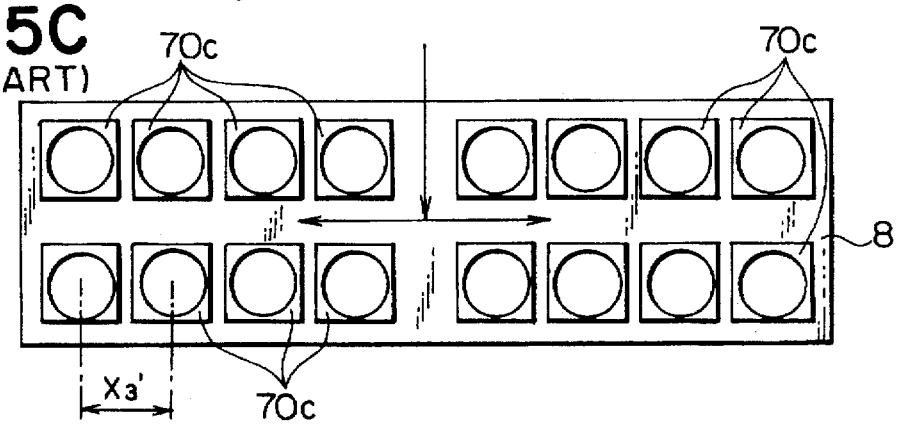
FIG. 5C (PRIOR ART)

FIG. 1 is a plan view, with parts broken away, a main portion of a vertical-type continuous casting apparatus according to a first embodiment of this invention. FIG. 2 is a fragmentary cross-sectional view of the casting apparatus, showing in detail the interior structure of a casting section of the apparatus. FIG. 3 is a plan view showing an example of arrangement of upper dies of different diameters in the casting apparatus. FIG. 4 is a plan view showing another example of arrangement of upper dies of different diameters in the casting apparatus. This invention should by no means be limited to casting the above-mentioned Al-alloy ingots and may be applied to the vertical-type continuous casting for other kinds of metal.

In the casting apparatus 1 of this embodiment, as shown in FIG. 1, molten metal from which gas is extracted in a non-illustrated molten metal processing unit is conveyed to a melting furnace 2 and a holding furnace 3 via conduits 4 to be concurrently poured into a plurality of casting sections 6*a*, 6*b*, 6*c* (FIG. 3) of different diameters from the respective runners 5. These casting sections 6*a*, 6*b*, 6*c* include a table 8 on which a plurality of upper dies 7*a*, 7*b*, 7*c* of different diameters are arranged in parallel rows as shown in FIGS. 1 and 2, a non-illustrated lower die support situated under the table 8 and supporting a plurality of lower dies 9 corresponding to the upper dies 7*a*, 7*b*, 7*c*, a non-illustrated water tank having a hollow, in which the lower die support is to be raised and lowered, and storing water inside, and a non-illustrated water supply for supplying cooling water to the individual lower dies 9. In the illustrated embodiment, the diameters of the upper dies 7*a*, 7*b*, 7*c* are 6, 7 and 8 inches, respectively.

The table 8 has, as shown in in FIG. 2, a multiplicity of through-holes 8*a* with diameters in which the individual lower dies 9 can be removably inserted; and on the table 8, a plurality of upper dies 7*a*, 7*b*, 7*c* are mounted in alignment with the respective through-holes 8*a*. Between the individual upper dies 7*a*, 7*b*, 7*c*, runners 5 are branched from the conduit 4 and have their ends projecting to the respective inlets of the upper dies 7*a*, 7*b*, 7*c* as shown in FIG. 1. Each upper die 7*a*, 7*b*, 7*c* is in the form of a block made of a heat-resistant material such as ceramics and having a tubular hollow, there being at a lower end portion of the block a water-cooling jacket 10 communicating with a ring-shape cooling water jet 11 opening diagonally downwardly in the tubular inside wall.

The lower die support has a structure well known in the art, so its description will be limited to a minimum here. The lower die support is in the form of a single plate supporting on its upper surface a multiplicity of lower dies 9 arranged one in alignment with each of the upper dies 7*a*, 7*b*, 7*c*. To the center of the lower surface of the support plate, the external end of a rod of a hydraulic cylinder mounted on the bottom of the water tank is fixed so that the lower dies 9 may be raised and lowered as a single unit at a predetermined speed in response to the expanding and shrinking action of the hydraulic cylinder. In the illustrated embodiment, the lower dies 9 have a common diameter substantially equal to the casting diameter of the large-diameter upper dies 7*c*.

FIGS. 3 and 4 show two different examples of arrangement of the casting sections 6*a*, 6*b*, 6*c*. In the example of arrangement of FIG. 3, the casting section 6*a* is composed of five small-diameter upper dies 7*a*; the casting section 6*b*, five intermediate-diameter upper dies 7*b*; and the casting section 6*c*, ten large-diameter upper dies 7*c*. The five small-diameter upper dies 7*a* and the five intermediate-diameter upper dies 7*b* are arranged in parallel straight rows in symmetry with respect to the central point of the table 8, while five of the ten large-diameter upper dies 7*c* and the remaining five large-diameter upper dies 7*c* are arranged in parallel straight rows in confronting relationship with the five small-diameter upper dies 7*a* and the five intermediate-diameter upper dies 7*b*, respectively. In the example of arrangement of FIG. 4, on the right half of the table 8, two small-diameter upper dies 7*a*, two intermediate-diameter upper dies 7*b* and one large-diameter diameter upper die 7*c* are arranged in straight row in this order, and in another straight row parallel to this, one small-diameter upper die 7*a*, two intermediate-diameter upper dies 7*b* and two large-diameter upper dies 7*c* are arranged in this order. The arrangement of the small-, intermediate- and large-diameter upper dies 7*a*, 7*b*, 7*c* on the left half of the table 8 is substantially mirror-image symmetrical to the arrangement of the upper dies 7*a*, 7*b*, 7*c* on the right half of the same table 8.

For an important feature of this invention, in order that possible load on the lower die support is uniform through its entire surface, weight of ingots to be cast by the individual upper dies 7*a*, 7*b*, 7*c* should be distributed as uniformly as possible on the lower die support. As long as this weight distribution is uniform, the arrangement of the upper dies 7*a*, 7*b*, 7*c* needs not be limited to the illustrated examples, so various other arrangements may be suggested.

In this invention, preferably, the upper dies 7*a*, 7*b*, 7*c* having different diameters and different casting diameters are identical in profile with one another, and the distances X1, X2, X3 between the respective centers of adjacent ones of the upper dies 7*a*, 7*b*, 7*c* are equal to one another. If the individual upper dies 7*a*, 7*b*, 7*c* have the same profile, it is possible to facilitate not only positioning but also attaching of new upper dies on the table 8 in substituting them for the old upper dies 7*a*, 7*b*, 7*c*. Further, if the distances X1, X2, X3, X4, X5 between the respective centers of adjacent ones of the upper dies 7*a*, 7*b*, 7*c* are set equal to one another, it is possible to convey all of ingots of different diameters to the next station, by a conveying means such as a crane, reliably without fail since the conveying means is set at a predetermined position even when the arrangement of the upper dies 7*a*, 7*b*, 7*c* of different diameters is changed.

Generally, if many upper dies 7*a*, 7*b*, 7*c* of different diameters are arranged on the table 8 as mentioned above, it is essential not only to pour molten metal into the upper dies respectively by a proper amount according to the respective die diameter, but also to secure a proper cooling rate according to the diameter of the respective upper die in order to manufacture high-quality products. Consequently, in this embodiment, each of the runners 5 has a non-illustrated weir member having a height commensurate with the diameter of each of the upper dies 7*a*, 7*b*, 7*c*, or each runner 5 is equipped with a non-illustrated flow control valve for adjusting an amount of molten metal to be poured into the respective upper die 7*a*, 7*b*, 7*c*. For securing a proper cooling rate according to the individual ingot diameter, the cooling water jet 11 is equipped with a non-illustrated valve under the respective upper die 7*a*, 7*b*, 7*c* to control an amount of cooling water to be sprayed per unit time.

According to the casting apparatus 1 of this embodiment, the molten metal 20 from which gas is extracted by the molten metal processing unit 3 as shown in FIG. 1 is poured into the cavities, which are each defined by the respective upper die 7*a*, 7*b*, 7*c* and the corresponding lower die 9, by a proper amount according to the diameter of the respective upper die, as shown in FIG. 2, via the runners 5. Upon start of this pouring, a proper amount of cooling water according to the diameter of the respective upper die 7*a*, 7*b*, 7*c* is sprayed diagonally downwardly from the cooling water jet 11, which is formed in the inside wall of the lower end of the respective upper die 7*a*, 7*b*, 7*c*, to cool the peripheral surface of the corresponding lower die 9. Simultaneously, the hydraulic cylinder for raising and lowering the lower dies 9 starts shrinking at a speed corresponding to the casting speed to lower the lower dies 9 toward and immediately short of the bottom of the non-illustrated water tank. During that time, ingots of different diameters, each having a circular cross section and solidified by cooling water jetted from the nozzle 11 and then water of the water tank, are continuously cast simultaneously.

When the lower dies 9 arrive at the lower limit, supply of cooling water from the cooling water jet 11 is stopped and, at the same time, the action of the hydraulic cylinder also is stopped. Subsequently, the hydraulic cylinder expands to raise the cast ingots until the upper end of each cast ingot projects from the respective upper die 7*a*, 7*b*, 7*c*. Then a non-illustrated crane pulls up all of the ingots of different diameters as a unit to convey them from the casting apparatus 1 to a non-illustrated uniform-heat furnace for the next stage of process.

The sections surrounded by phantom lines in FIGS. 3 and 4 are auxiliary casting sections. These auxiliary casting section are not used unless they are needed; desired auxiliary upper dies 7a', 7b', 7c' existing in the auxiliary casting section are used for casting such extra ingots. For this purpose, each runner 5 (shown schematically in FIG. 3 and 4) has a control valve 5a to control flow of molten metal for the respective auxiliary upper dies 7a', 7b', 7c' according to demands.

As is apparent from the foregoing description, with the casting apparatus of this invention, since a multiplicity of upper dies 7a, 7b, 7c having different casting diameters for casting ingots of different diameters are arranged on a common table 8, it is possible to reduce the number of ingots of the same diameter, which are to be obtained in a single casting, thus minimizing the total stock. Further, since the arrangement of upper dies 7a, 7b, 7c of different diameters can be changed to meet the working conditions in a subsequent station for extruding process thus adjusting the total stock to an optimum.

Further, since an adequate number of upper dies 7a, 7b, 7c having different casting diameters are arranged on a common table 8, it is unnecessary to exchange molds. Even when necessary, it is possible to exchange the upper dies 7a, 7b, 7c with extra upper dies having a necessary casting diameter on the same table 8, so it is possible to flexibly cope with the production of a demanded quantity of ingots. Still further, if the upper dies 7a, 7b, 7c have a common profile, it is possible to facilitate exchange of the upper dies with extra upper dies and also to reduce the area of installation of the casting apparatus to a minimum.

Assuming that many ingots of a specified diameter have to be cast, the auxiliary upper dies 7a, 7b, 7c can be used or may be exchanged with extra upper dies for casting ingots of the specified diameter, realizing flexible manufacturing of ingots having specified diameters and varying in number. Further, since upper dies 7a, 7b, 7c of a desired diameter can be arranged at desired positions on the table 8, it is possible to change the arrangement of upper dies 7a, 7b, 7c in view of better balance of load or easy removable of ingots.

According to another feature of this invention, since the distances between the centers of individual ingots are equal to one another even though they have different diameters, the individual ingots can be gripped at a fixed position, enabling reliable and simultaneous removal of all ingots of different diameters for one casting and hence realizing automatic manufacturing. Further, depending on the arrangement of upper dies 7a, 7b, 7c having different casting diameters, the ingots can be removed, conveyed and arranged in the order of diameter, causing effective working and balancing loads of different weights due to the ingots of different diameters. Accordingly it is possible to cast ingots precise in size so that high-quality extruded products can be manufactured from the precise ingots.

What is claimed is:

1. A vertical-type continuous casting method for continuously casting a plurality of ingots comprising the steps of:

providing a plurality of molds each composed of upper and lower dies;

pouring molten metal into said upper dies;

lowering said lower dies in a predetermined path at a casting speed away from said upper dies, wherein said upper dies are supported on a common table and have different casting diameters for casting the ingots of different diameters simultaneously on said common table.

2. A vertical-type continuous casting apparatus for continuously casting a plurality of ingots, comprising a plurality of molds for receiving poured molten metal, each mold composed of upper and lower dies, said lower dies arranged to be movable away from said upper dies in a predetermined path;

a mechanism for moving said lower dies along said predetermined path at a casting speed;

wherein said upper dies have different casting diameters and are arranged on a common table, and said lower dies are movable with respect to said table.

3. A vertical-type continuous casting apparatus according to claim 2, comprising a molten metal runner connecting said upper dies via branch runners, and wherein said upper dies additionally include one or more auxiliary upper dies and said molten metal runner includes valves for selectively opening or closing branch runners to said auxiliary upper dies.

4. A vertical-type continuous casting apparatus according to claim 2, wherein said upper dies have common outside dimensions and are arranged with a uniform distance between centers of casting diameters of each adjacent pair of said upper dies.

5. A vertical-type continuous casting apparatus according to claim 2, wherein said upper dies having different casting diameters are arranged on said table so as to be divided into groups each composed of said upper dies of a same casting diameter.

6. A vertical-type continuous casting apparatus according to claim 2, wherein said upper dies on said table are arranged in such a manner that distribution of load of the ingots may be substantially uniform.

* * * * *